US006212725B1

(12) United States Patent
Porat

(10) Patent No.: US 6,212,725 B1
(45) Date of Patent: Apr. 10, 2001

(54) SEGMENTED BRUSH ASSEMBLY FOR POWER DRIVEN POOL CLEANER

(75) Inventor: Joseph Porat, North Caldwell, NJ (US)

(73) Assignee: Aqua Products Inc., NJ (US)

( * ) Notice: Subject to any disclaimer, the term of this patent is extended or adjusted under 35 U.S.C. 154(b) by 0 days.

(21) Appl. No.: 09/162,952

(22) Filed: Sep. 29, 1998

(51) Int. Cl.[7] ..... E04H 4/16
(52) U.S. Cl. ..... 15/1.7; 15/230.14; 15/244.4
(58) Field of Search ..... 15/230.11, 230.12, 15/230.14, 1.7, 97.1, 98, 244.1, 244.4

(56) References Cited

U.S. PATENT DOCUMENTS

| | | | | |
|---|---|---|---|---|
| 2,659,935 | * | 11/1953 | Hammon | 15/244.4 |
| 2,955,309 | * | 10/1960 | Brown | 15/230.11 |
| 3,694,845 | * | 10/1972 | Engelsher | 15/244.4 |
| 4,445,247 | * | 5/1984 | Johannessen | 15/98 |
| 4,482,391 | * | 11/1984 | Pettingell et al. | 15/230.14 |
| 4,573,233 | * | 3/1986 | Stoop | 15/230.11 |
| 4,577,364 | * | 3/1986 | Demetriades | 15/230.14 |

FOREIGN PATENT DOCUMENTS

| | | | | |
|---|---|---|---|---|
| 715950 | * | 9/1954 | (GB) | 15/230.11 |
| 2061455 | * | 5/1981 | (GB) | 15/230.11 |
| 2186188 | * | 8/1987 | (GB) | 15/230.14 |
| 93653 | * | 4/1988 | (JP) | 15/230.14 |

* cited by examiner

*Primary Examiner*—Gary K. Graham
(74) *Attorney, Agent, or Firm*—Abelman Frayne & Schwab

(57) ABSTRACT

A cleaning brush for a power-driven robotic pool cleaner is formed from a plurality of cylindrical sections of water-expandable compressed cellulose sponge material that are preferably die-cut from a sheet or web, each section having a central opening corresponding in both size and shape to the cross section of the rotatable shaft on which the cylindrical sections are mounted in spaced relation. When wet with water, the compressed cellulose sponge material expands many times its original compressed thickness to provide a cleaning brush having continuous coverage over the entire length of the shaft.

14 Claims, 2 Drawing Sheets

FIG.1
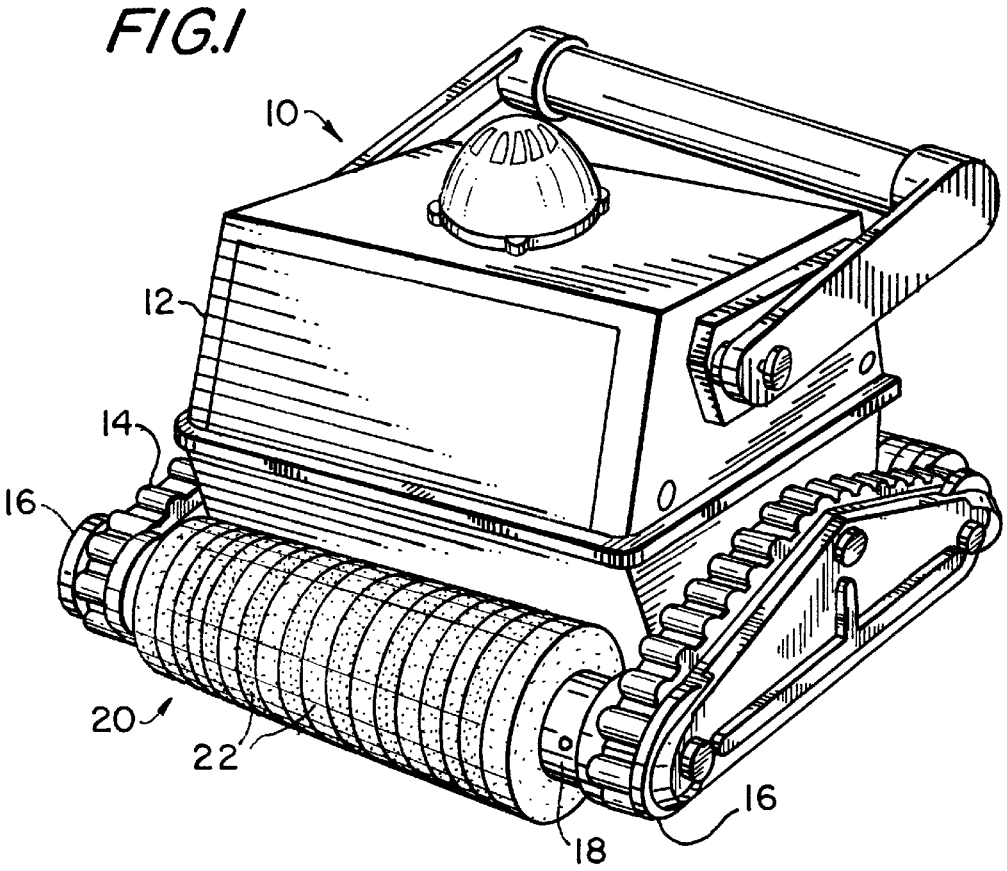
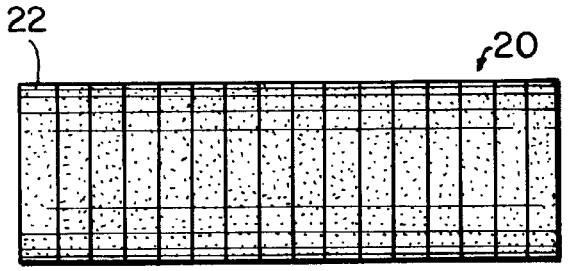
FIG.2
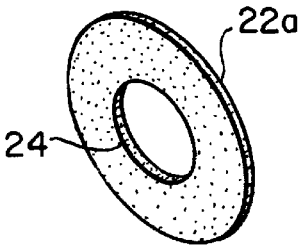
FIG.3a
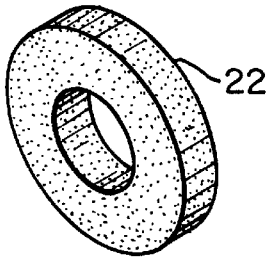
FIG.3b

SEGMENTED BRUSH ASSEMBLY FOR POWER DRIVEN POOL CLEANER

FIELD OF THE INVENTION

This invention relates to replaceable rotating brushes for mounting on power-driven pool cleaners.

BACKGROUND OF THE INVENTION

Automated power driven pool cleaners typically include rotating brushes mounted on tubes or shafts extending across the body at the front and rear of the machine. The shaft on which the cleaning brush is mounted is rotatable and can be driven by one or more endless belts that engage grooved pulleys at either or both ends of the rotatable shaft.

The cleaning brushes can be made of foam, in which case they are subject to wear and tear due to their continuous rotating contact with the bottom and side wall surfaces of the pool. As a result, foam cleaning brushes must be periodically removed and replaced. Various types of brushes have been used with pool cleaning machines of the prior art. Brushes in the form of elongated cylinders produce from molded polyvinyl acetate (PVA) having a relatively fine pore size are designed to cover the entire length of the rotatable shaft in a single piece. The molded PVA is relatively rigid when dry, but becomes softer and more elastic when wet with water which facilitates fitting it to the shaft.

Other types of brushes are formed as generally rectangular elements having a flat surface on the back which can be tightly fitted to the rotatable shaft. Interlocking tabs and openings at the mating ends of the mat permit its secure assembly to the shaft. Elements of various configurations projecting from the exterior surface of the mat contact the pool surface with a scrubbing action to loosen debris and allow it to be drawn into the pool cleaner's filter system. The flat brushes can be produced as an integrally molded element using a synthetic rubber compound. The flat brushes can also be fabricated by drawing elongated rectangular pieces of cellular foamed plastic through openings in an open-weave backing material.

While each type of cleaning brush possesses certain advantages, and is intended for use under specific conditions, each requires a substantial capital investment in order to provide special molds and other equipment required to manufacture the brushes. In addition, the materials and manufacturing processes required for each of the types of brushes described add further to the cost of the finished article.

A further drawback associated with the use of these prior art brushes is the effort associated with removing a worn brush and installing a replacement cleaning brush. In the case of the cylindrical PVA foam brush, the old element can most easily be removed by cutting it away from the shaft. However, considerable effort is required to pull and properly fit the replacement brush to the shaft. The dismounting of the flat brush is likewise facilitated by cutting the neck portion of the tabs where the mating ends overlap. Installing the new brush requires some strength, since the tabs and slots of the overlying ends must be brought into mating alignment and the interlocking elements have limited resiliency to insure that they do not disengage once assembled in the correct interlocking position. Installation of the brushes can prove difficult for residential pool owners.

In view of the above observations, it would be desirable to provide a cleaning brush for pool cleaners as original equipment or as a replacement for worn or damaged cleaning brushes, that is both economical to manufacture and that is easy to install and remove.

It is therefore an object of the invention to provide a cleaning brush that can be produced from inexpensive and readily available materials.

It is another object of the invention to provide a means for fabricating cleaning brushes that are relatively inexpensive and use standard production equipment and methods.

It is also an important object of the invention to provide cleaning brushes that are easy to install and that can be easily removed at such time as replacement is required.

SUMMARY OF THE INVENTION

The above objects, as well as additional advantages, will be realized in the practice of the invention as herein described. In its broadest embodiment, the improved cleaning brush comprises a plurality of cylindrical sections of water-expandable compressed cellulose sponge material having a central opening corresponding in both size and shape to the cross section of the rotatable shaft on which the cylindrical section is to be mounted. A plurality of these cylindrical, or annular, sections are mounted in spaced relation to each other on the rotatable shaft. When wet with water, the compressed cellulose sponge material expands many times its original compressed thickness to provide continuous coverage over the entire length of the shaft. In their dry compressed state, the annular sections can easily be slipped onto and moved into proper position on the shaft. No particular skill or strength is required to position the compressed elements on the shaft. In a preferred embodiment, the shaft is provided with spaced markings to indicate the proper position and spacing for the annular compressed sponge sections.

The annular sections can be easily die cut from a sheet or web of compressed cellulose sponge. Because the sponge material is easily die cut, multiple sheets can be stacked to produce a plurality of die cut sections with each action of the die-cutting machine. A suitable compressed cellulosic sponge material is available from the 3M Company of Tonawanda, N.Y., under the trademark O-Cel-O. The sections can be of the same or differing thickness.

BRIEF DESCRIPTION OF THE DRAWINGS

The invention will be further described with reference to the drawings in which like elements are represented by the same number, and FIG. 1 is a prospective view of a pool cleaner fitted with the improved brush of the invention;

FIG. 2 is a front elevation view of one embodiment of the invention;

FIG. 3A is a prospective view of one segment in compressed form;

FIG. 3B is a prospective view of the element of FIG. 3A in expanded form;

DESCRIPTION OF THE PREFERRED EMBODIMENTS

Figure 4:
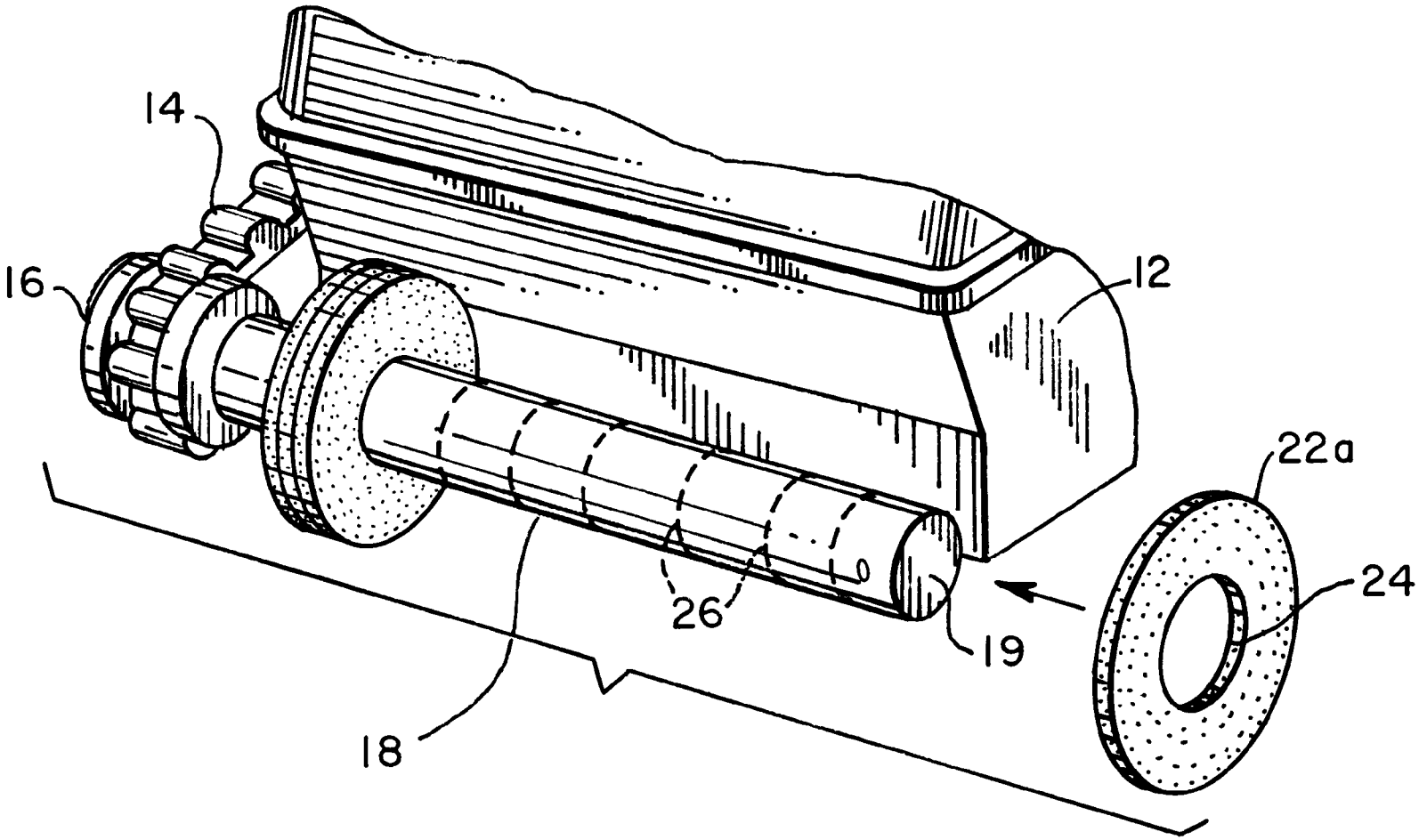
FIG. 4 is a partial prospective view illustrating the assembly of the improved segmented cleaning brush of the invention employing the elements of FIG. 3A.

With reference to FIG. 1, the pool cleaner 10 comprises a housing or cover 12 and a pair of side-mounted drive belts 14 that engage pulleys 16 at the forward and aft ends of the cleaner. Pulleys 16 are mounted and secured to the ends transverse axles or shafts 18 which extend across the width of the pool cleaner 10. As shown in FIG. 1, the cleaning brush assembly is mounted on rotatable shaft 18 so that the brush assemblies 20 at the forward and aft ends support pool cleaner 10 as it traverses the bottom and side walls of the pool during cleaning.

The cleaning brush assembly 20, as shown FIG. 2 is, in a preferred embodiment, assembled from a plurality of cylindrical sections of water-expandable compressed cellulose sponge material. As shown in FIG. 3A, the compressed cellulose sponge section is annular, the cylindrical section having a central opening or orifice 24 which corresponds to the size and shape of the cross section of the rotatable shaft 18 on which it is mounted. When contacted with water, i.e., as when the pool cleaner is emersed in the pool, the compressed cellulose sponge quickly expands in thickness or height to the configuration illustrated in FIG. 3B.

The outside diameter of the annular section 22 measures about 3.5 inches, and corresponds to that of a worn molded brush element that it replaces. The section is die-cut from a sheet approximately one-eighth inch thick. The number of annular cellulose sections 22 placed on rotatable shaft 18 is predetermined to provide the expanded assembly 20 that will extend across the width of the pool cleaner without leaving any gaps between the individual sections.

As indicated by the shading of FIG. 2, the individual annular sections 22 can be produced in different colors to provide the appearance of alternating colored bands across the width of the assembly 20. The use of a lighter color sponge material in alternating relation with one or more contrasting colors can serve the function of indicating the accumulation of dirt and fine debris in the outer-porous surface of the expanded sponge. The use of two or more contrasting colors also provides a pleasing aesthetic appearance, particularly when the colors are coordinated with those of the pool cleaner housing 12, as well as other elements of the assembly comprising pool cleaner 10.

In a preferred embodiment illustrated in FIG. 4, the rotatable shaft 18 is provide with spaced markings or indicia 26 to indicate the proper location of compressed annular cellulose elements 22A to provide for the appropriate fit of the elements as the cellulose sponge expands when wet. As indicated in FIG. 4, the diameter of the central opening 24 in the annular element 22A is of the same size and configuration as the cross-section 19 of shaft 18 so that a close sliding fit is obtained.

In another preferred embodiment of the invention (not shown) one or more expanded cellulose sponge elements 22 are positioned at either end of the rotatable shaft 18 and the intervening space is occupied by a section of a conventional cleaning brush of the prior art. The installation of one or more of the expanded cellulose sections 22 improves the wall climbing traction of the cleaner 10.

In another embodiment, two or more compressed annular sections can be permanently or temporarily bonded together, as by adhesive. Preassembly of two or more sections is useful in expediting assembly of the complete brush and in providing predetermined color combinations.

When one or more sections of the brush assembly of the invention become worn or damaged, the section or the sections to be replaced can be easily cut or removed by sliding from the rotatable shaft 18. Sections that remain serviceable need not be replaced, providing a further potential savings from the invention.

Since the compressed sections are compact and lightweight, they can be shipped in a mailing envelope, thus permitting further economies to be realized in stocking and supplying replacements to customers and repair facilities.

I claim:

1. A cleaning brush assembly mounted on a rotatable shaft of a power-driven swimming pool cleaning apparatus for contacting the submerged surfaces of the pool to be cleaned, the brush assembly comprising a plurality of compressed cylindrical sections of water-expandable cellulose sponge, each section having a central orifice corresponding in size and shape to the cross-section of the rotatable shaft and a cylindrical peripheral surface, the plurality of sections being mounted on the rotatable shaft in predetermined spaced relation, whereby the adjacent sections expand into abutting contact and the peripheral surfaces form a continuous cleaning surface for contacting the pool surfaces to be cleaned when the assembly is immersed in water.

2. The brush assembly of claim 1 where the sections of compressed cellulose sponge are compressed to approximately ten percent of their expanded thickness when wet with water.

3. The brush assembly of claim 1 where the sections are formed from a fine pore cellulosic sponge.

4. The brush assembly of claim 1 where the cylindrical sections are die-cut from a sheet of compressed cellulose sponge.

5. The brush assembly of claim 1 where the cylindrical sections are cut from a block of compressed cellulose sponge.

6. The brush assembly of claim 1 where two or more of the cylindrical sections are bonded together in axial alignment.

7. The brush assembly of claim 1 where the cellulosic sponge is permanently colored.

8. The brush assembly of claim 7 where adjacent sections are of different colors.

9. The brush assembly of claim 8 where the sections differ in thickness.

10. The brush assembly of claim 1 where the rotating shaft is cylindrical and the central orifice of the cellulose sponge is circular.

11. The brush assembly of claim 10 where the central orifice is coaxial with the cylinder.

12. The brush assembly of claim 1 where the water-expandable sections are all of the same thickness.

13. The brush assembly of claim 1 comprising water-expandable sections of differing thicknesses.

14. The brush assembly of claim 1 comprised of a least eight sections.

* * * * *